United States Patent [19]

Clark et al.

[11] Patent Number: 4,903,858

[45] Date of Patent: Feb. 27, 1990

[54] REFRIGERATOR CABINET ASSEMBLY

[75] Inventors: Oliver R. Clark, Louisville, Ky.; John M. Powell, Charlestown, Ind.

[73] Assignee: General Electric Company, Louisville, Ky.

[21] Appl. No.: 340,921

[22] Filed: Apr. 20, 1989

[51] Int. Cl.[4] ..... B65D 88/74

[52] U.S. Cl. ..... 220/430; 62/277; 62/440; 220/444; 220/467

[58] Field of Search ..... 62/277, 450, 440, 465; 220/71, 430, 444, 467; 312/214

[56] References Cited

U.S. PATENT DOCUMENTS

| | | | |
|---|---|---|---|
| 2,997,353 | 8/1961 | Horvay | 312/214 |
| 3,627,165 | 12/1971 | Cobb | 220/444 |
| 4,474,017 | 10/1984 | Prada | 62/277 |
| 4,558,503 | 12/1985 | Wilson | 312/214 |
| 4,586,348 | 5/1986 | Nakayama et al. | 220/467 |

*Primary Examiner*—Jimmy G. Foster
*Attorney, Agent, or Firm*—Frederick P. Weidner; Radford M. Reams

[57] ABSTRACT

A cabinet assembly for a refrigerator having two top front corners. The cabinet has an outer sheet metal shell having a top panel, side panels and a front face. The front face is formed to provide a first U-shaped portion and a second U-shaped portion with a groove area in the second U-shaped portion. There is a brace located at each of the two top front corners of the cabinet and each has two joined sections at right angles to each other and each section is formed as an inwardly open U-shaped channel having a base, a first leg and a second leg spaced apart and integrally joined to the base. The brace has at least one resilient hook shaped latch element on each of the two joined sections. The latch elements extend from the first leg beyond the base and engage the second U-shaped portion in the groove area to secure the brace to the outer metal shell.

12 Claims, 3 Drawing Sheets

FIG.3
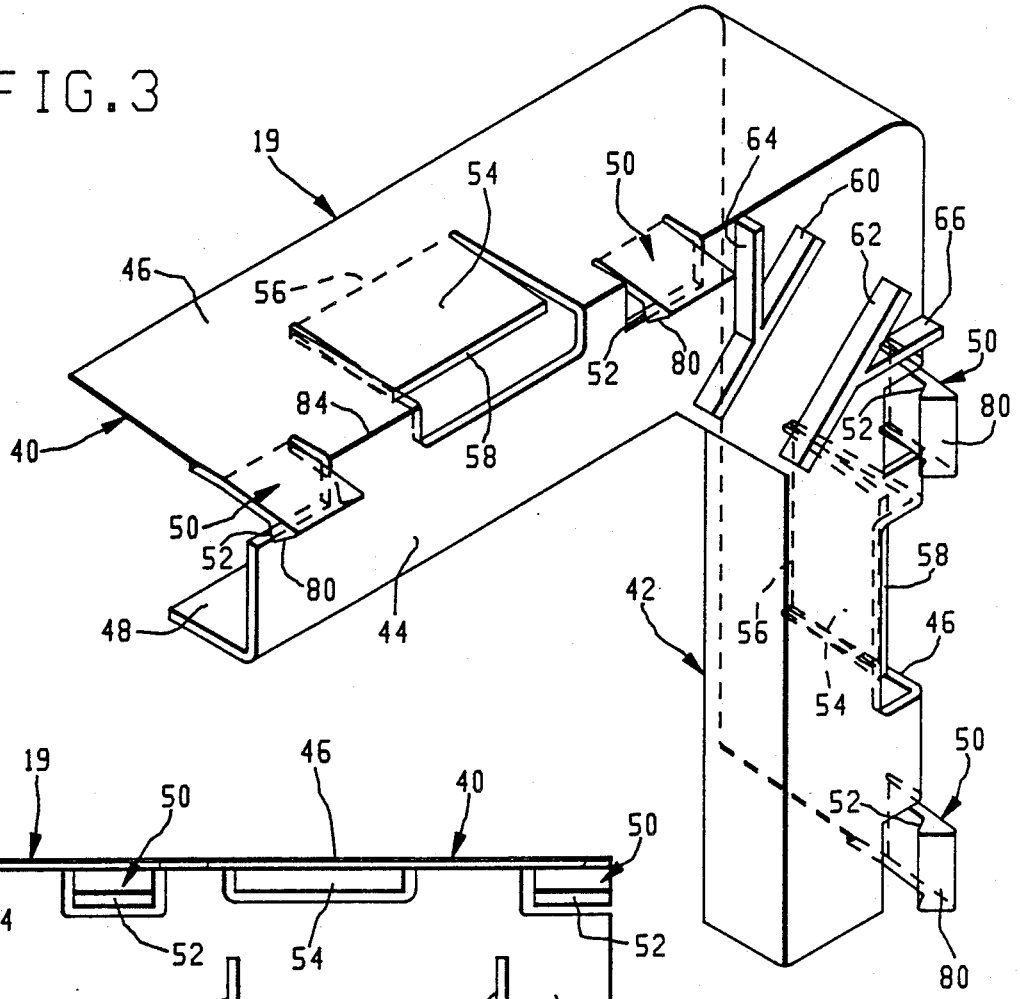
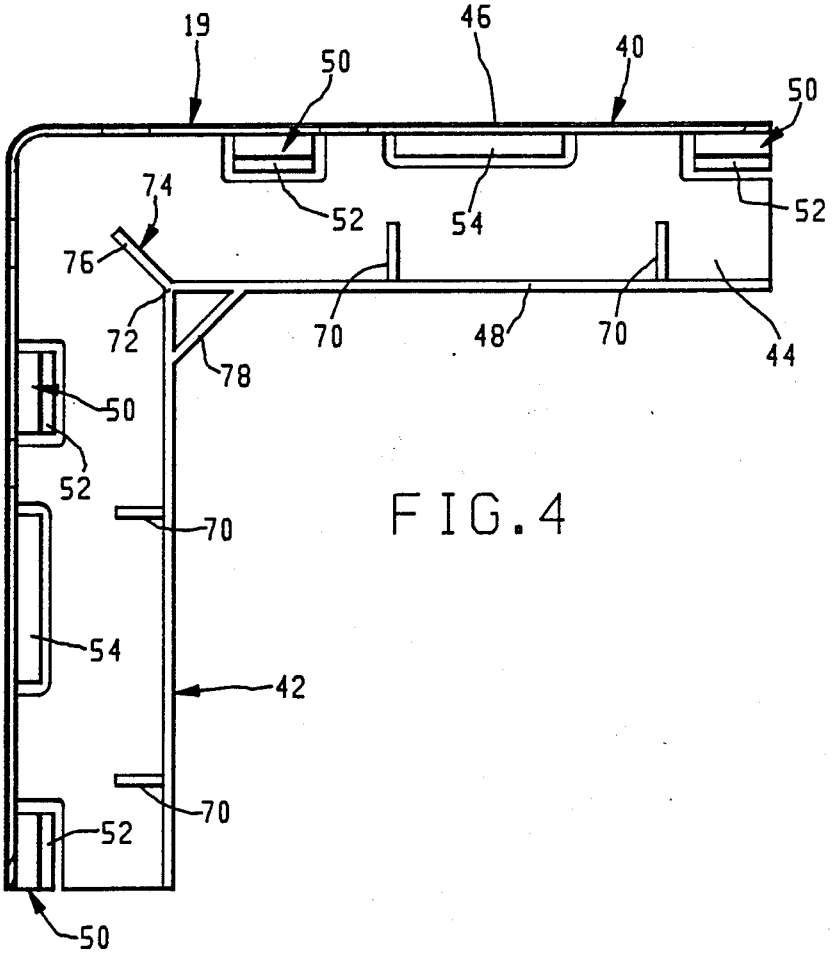
FIG.4

REFRIGERATOR CABINET ASSEMBLY

BACKGROUND OF THE INVENTION

This invention relates to household refrigerators and in particular to the cabinet assembly for a refrigerator having a freezer compartment on top, a fresh food compartment on the bottom, and incorporating the hot liquid anti-sweat loop.

It is common practice in the manufacture of household refrigerators to incorporate corner braces for the outer metal shell to reinforce the metal shell and give it strength in those areas where the door hinges are to be secured to the outer metal shell. Moreover, these corner braces give support to the outer metal shell during manufacturing assembly of the refrigerator especially when the outer metal shell is formed from very thin sheet metal and it needs to be carried on a conveyor through the assembly line.

The refrigeration system of a household refrigerator includes a compressor, condenser and evaporator wherein refrigerant is compressed by the compressor to produce hot gas which is pumped to the condenser. The condenser turns the gas to liquid which subsequently passes through the liquid line and a capillary tube to the evaporator where heat from inside the refrigerator is used to boil the liquid in the evaporator and the resultant gas is then returned to the compressor by the suction line.

It is normal for refrigerators and particularly the freezer compartment of the refrigerators to have some small amount of cold air leakage and/or normal conduction through the gasket sealing the access door to the freezer compartment and that small amount of leakage can cause the front face to be cold. Condensation results around the face of the freezer compartment when warm humid room ambient air comes in contact with the cold surface. It is common to use an anti-sweat heater to warm the area around the front face of the freezer compartment so that condensation is minimized. Often the heater is a part of the condenser and is referred to as the "anti-sweat loop".

The hot anti-sweat loop must be bent at right angles to fit in the top corners of the front face of the refrigerator and there needs to be a means to hold the anti-sweat loop in its proper position in those areas. One such way is to use the metal braces disclosed in U.S. Pat. No. 4,735,062 assigned to the same assignee as the present invention. It will be noted from that patent that the braces are formed from rather heavy metal and are secured by separate fastening means such as metal stitching wherein the metal brace and the outer metal shell of the refrigerator cabinet are held together by having a section of each upset one within the other to provide an integral fastener formation. Such fastening means is well known in the art of fastening two metal panels together. One such metal fastening means known in the trade is LANCE-N-LOC or TOG-L-LOC and the equipment necessary for such a fastening operation is sold by BTM Corporation, Marysville, Mich. While such an assembly and fastening means is quite suitable, it does require rather expensive corner braces and equipment to perform the fastening means which entails an additional manufacturing assembly operation.

By this invention several advantages are obtained, one of which is that the brace may be secured to the outer metal shell without the need of separate fastening means such as metal stitching but rather the corner brace is merely snapped in place. In those refrigerators utilizing an anti-sweat loop the brace also includes means for positively retaining the anti-sweat loop in its proper position as it transitions around the top right angle corners in the front face of the refrigerator. Moreover, the brace may be formed of plastic material which is a substantial cost saving, yet accomplishes the rigidity needed for bracing the corners of refrigerators especially during manufacturing assembly of the refrigerators.

SUMMARY OF THE INVENTION

There is provided a cabinet assembly for a refrigerator having two top front corners formed in an outer metal shell having a top panel, side panels and a front face. The front face is formed to provide a first U-shaped portion which includes a first outer wall perpendicular to the side panel to form a corner and a second inner wall spaced from the first outer wall, both walls being connected by the first U-shaped portion, said second inner wall being reversely bent to form a third wall and provide a second U-shaped portion formed between the second inner wall and the third wall. The first, second and third walls are in spaced parallel planes with the third wall being bent at a right angle to form a flange having a free terminal edge. The second U-shaped portion is formed to provide a groove area therein.

The cabinet assembly may, if desired, particularly in the case of a refrigerator having a freezer compartment on top, also include a hot anti-sweat loop from the condenser unit of the refrigeration system to transfer heat from the hot loop to the front face on three sides of the freezer compartment to minimize condensation on those surfaces.

A brace is located at each of the two top front corners of the cabinet and each brace has two formed sections at right angles to each other and each section is joined as an inwardly open U-shaped channel having a base, a first leg and a second leg spaced apart and integrally joined to the base. The base is located adjacent the rear surface of the third wall of the front face with the first leg parallel to and abutting the side and top panels of the cabinet and the second leg is parallel to and abutting the flange of the front face. Each brace has at least one resilient hook shaped latch element on each of the two joined sections that extend from the first leg beyond the base and engage the second U-shaped portion in the groove area to secure the brace to the outer metal shell.

With this assembly the brace may be secured to the outer sheet metal shell without the need of separate fastening means. In those refrigerators utilizing an anti-sweat loop there may also be provided means to secure a portion of a hot anti-sweat loop to the braces and hold the loop in its proper position during assembly of the refrigerator.

BRIEF DESCRIPTION OF THE DRAWINGS

FIG. 3 is a perspective view of the shape of the corner brace utilized in the present invention.

FIG. 4 is a plan view of the corner brace utilized in the present invention.

DESCRIPTION OF THE PREFERRED EMBODIMENT

Figure 1:
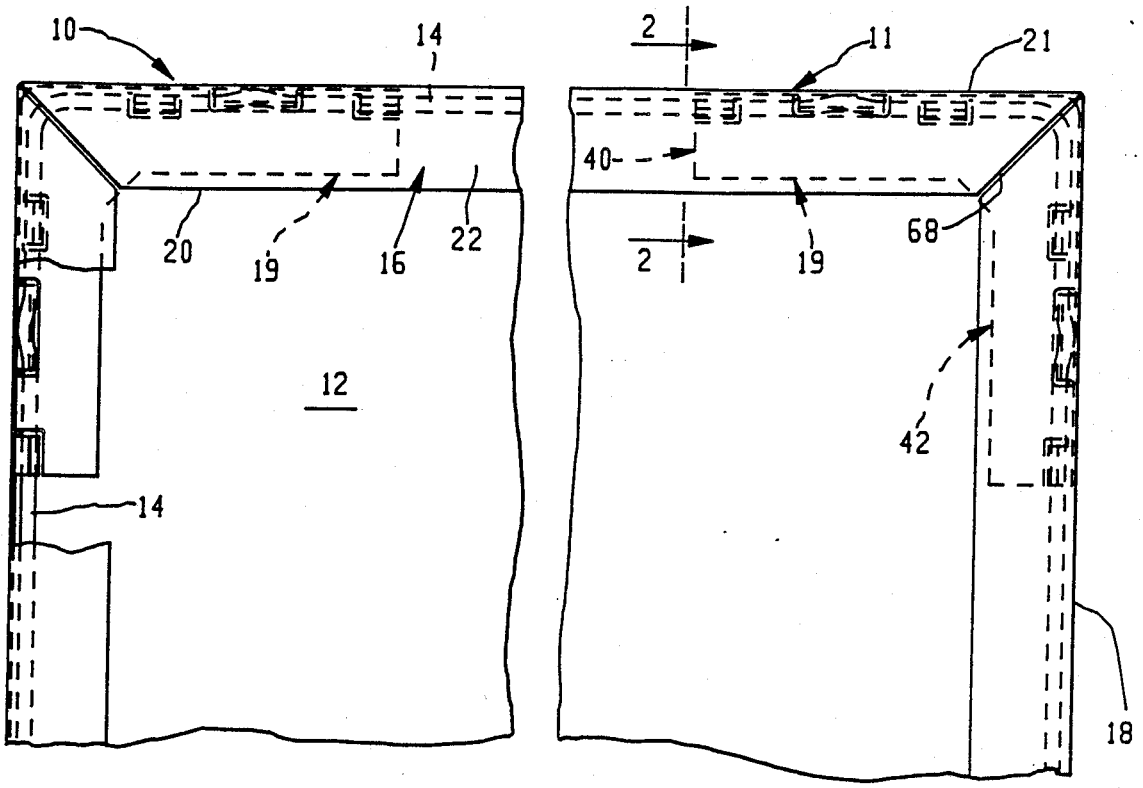
FIG. 1 is a front elevational view of the top portion of a household refrigerator having a freezer compartment on top showing a portion of the present invention.
Figure 5:
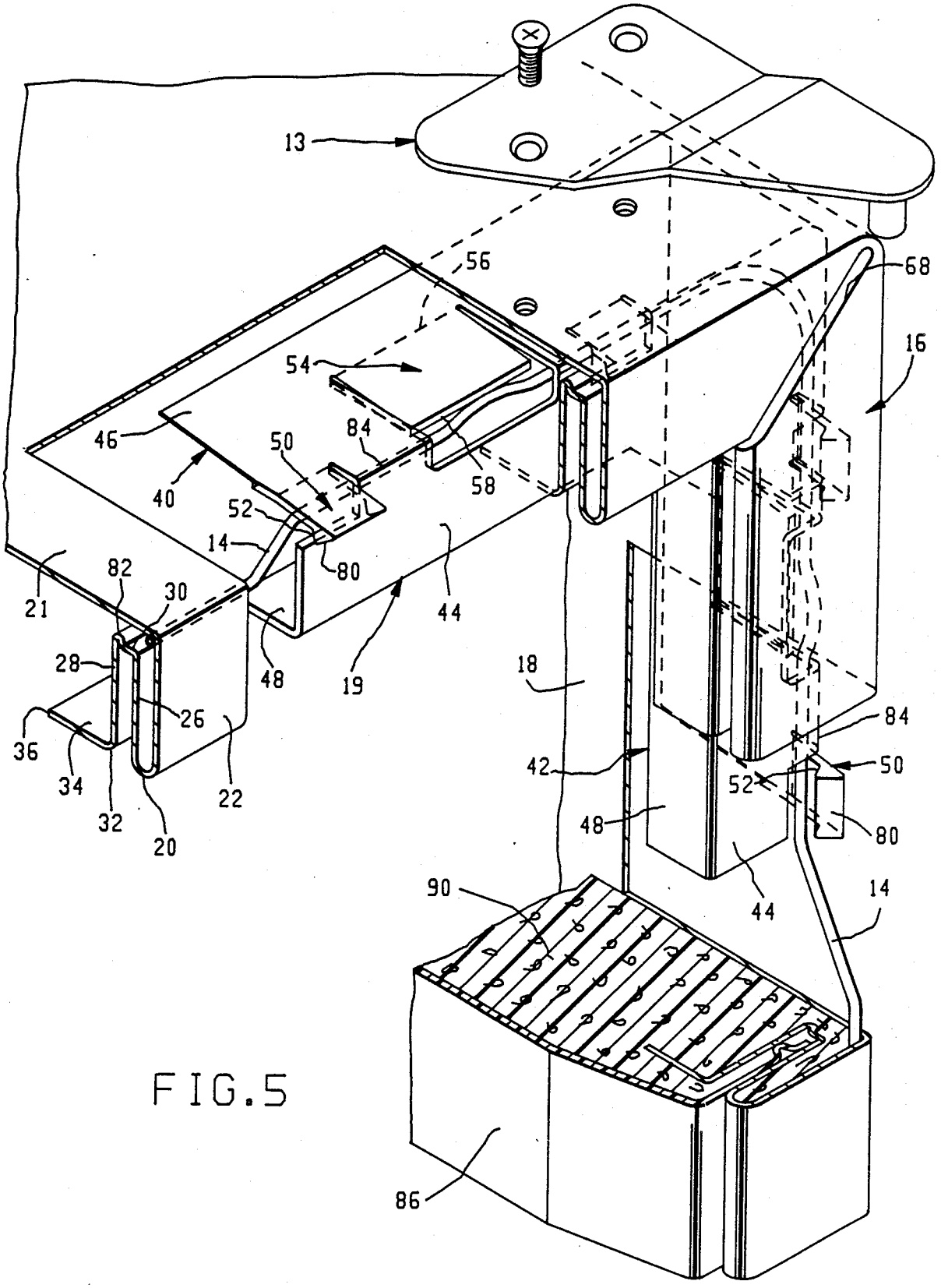
FIG. 5 is a perspective view partly in cross-section showing the present invention.

With reference to FIG. 1, there is shown the top portion of a household refrigerator 10 having an outer metal shell 11 with a freezer compartment generally shown as 12 located at the top of the refrigerator. Such household refrigerators are quite common and also include a fresh food compartment (not shown) located at the bottom of the refrigerator with the freezer and fresh food compartment separated by a thermal insulating partition. Both the freezer and fresh food compartments are closed by a gasketed door hingedly attached to one side of the refrigerator by hinge plates 13 (FIG. 5). This type of household refrigerator also has a refrigeration machinery compartment (not shown) at the bottom of the refrigerator and separated from the bottom fresh food compartment. The machinery compartment has the refrigeration apparatus which includes a compressor and a condenser which is in the form of an elongated tube formed in a serpentine pattern commonly used in refrigeration systems. In the case of refrigerators that have the front face heated to minimize sweating, there is a hot anti-sweat loop 14 around the front face 16 of the freezer compartment 12. The sweating can occur due to normal conduction and/or leakage of cold air from within the freezer compartment which causes the front face 16 to be cold and the warmer humid room ambient air that comes in contact with the cold surface or front face 16 condenses. The hot anti-sweat loop 14 is utilized to warm the front face 16 to prevent the condensation that would normally take place.

Figure 2:
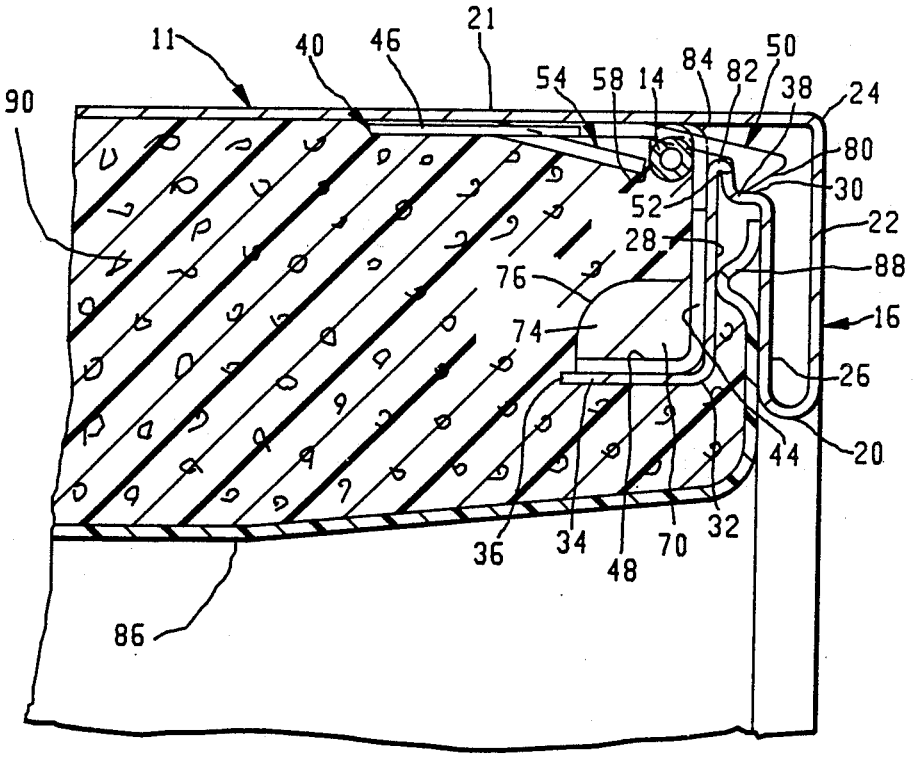
FIG. 2 is a cross sectional view taken along line 2—2 of FIG. 1.

With reference particularly to FIGS. 1, 2 and 5, the top front corner structural arrangement of the refrigerator is shown. The outer metal shell 11 of the refrigerator 10 has a side panel 18 and a top panel 21 and a front face 16 which extends across the top of the refrigerator and down along the sides of the freezer compartment 12. The front face is formed to provide a first U-shaped portion 20 which includes a first outer wall 22 perpendicular to the side panel 18 or top panel 21 to form a corner 24 and a second inner wall 26 spaced from the first outer wall 22. Second inner wall 26 is reversely bent to form a third wall 28 and provide a second U-shaped portion 30 formed between the second inner wall 26 and the third wall 28. The first, second and third walls 22, 26 and 28 respectively are in spaced parallel planes with the third wall 28 bent at a right angle 32 to form a flange 34 with a free terminal edge 36. The second U-shaped portion 30 has formed therein a groove 38 that runs longitudinally along the second U-shaped portion.

Located at each of the top front corners of the outer metal shell 11 are braces 19, only one of which will be described in detail as both braces are identical. With particular reference to FIGS. 3 and 4, the brace 19 is molded from suitable plastic material and has two integrally joined sections 40 and 42 at right angles to each other and each section is formed as an inwardly open U-shaped channel having a base 44, a first leg 46, and a shorter second leg 48 spaced apart and integrally joined to the base 44. Each of the to joined sections 40 and 42 have at least one resilient hook shaped latch element 50 and the hook portion 52 extends from the first leg 46 beyond the base 44. In the preferred embodiment and as shown in FIGS. 3 and 4, there are two resilient hook shaped latch elements 50 on each of the sections 40 and 42 with the latch elements of each section spaced from each other a substantial distance along each of the sections 40 and 42. These resilient hook shaped latch elements 50 are integrally molded with the brace 19 and the hook portion 50 diverges downwardly from the plane of the first leg 46. In a refrigerator that utilizes a hot anti-sweat loop, such as shown in the drawing, each corner brace has means to retain the hot anti-sweat loop within the inwardly open U-shaped channel. One retainer means is shown in the drawing wherein the two formed sections 40 and 42 of the brace 19 each has a lanced tang 54 preferably intermediate of the spaced hook shaped latch elements 50. The lanced tang 54 is hingedly joined at one end 56 to the first leg 46 and has a front terminal end 58 spaced from the base 44. The tang 54 is resilient and formed to diverge downwardly from the first leg 46 between the hinged end 56 of the tang and the front terminal end 58. The distance between the front terminal end 58 and the base 44 of the brace is dimensioned to receive in close tolerance the hot anti-sweat loop 14.

As seen in FIG. 3, in the area where the two sections 40 and 42 are integrally joined there are two parallel upstanding elongated projections 60 and 62 which are spaced apart from each other and are located on a 45° angle relative to the longitudinal axis of sections 40 and 42 respectively. Diverging outwardly from the projections 60 and 62 are smaller projections 64 and 66 respectively which are perpendicular to the longitudinal axis of the respective sections 40 and 42. The purpose of the projections 60, 62 and the smaller projections 64 and 66 is to receive a plug material such as foamable hot melt which solidifies and minimizes leakage of the foam resin during the subsequent foaming operation to insulate the refrigerator cabinet which will be discussed later.

As seen particularly in FIG. 4, the plan view shows the interior of the brace 19 and there is shown reinforcing gussets 70 molded integrally between the second leg 48 and the base 44. In the corner area 72 where the second leg 48 of the first section 40 and the second leg 48 of the second section 42 are integrally joined, there is an inwardly projecting guide element 74 which is molded between the second legs 48 in the corner area and the base 44 of the brace. In the preferred embodiment the edge 76 is curved from the top of the second leg 48 downwardly to join the base 44. There may also be a diagonal reinforcing strut 78 between the right angled second legs 48 of the first section 40 and second section 42.

With particular reference to FIGS. 2 and 5, the corner braces 19 are inserted between the side panel 18 and top panel 21 of the outer metal shell 11 and the third wall 28 of the front face 16 so that the base 44 of brace 19 is located adjacent the rear surface of the third wall 28 of the front face 16 with the first leg 46 of section 40 parallel to and abutting the top panel 21 of the cabinet outer metal shell 11, the first leg 46 of section 42 parallel to and abutting the side panel 18 and the second leg 48 of each brace section 40 and 42 being parallel to and abutting flange 34 of the front face 16. During movement of the brace into the position described above relative to the outer metal shell 11, the forward surface 80 of the hook portion 52 contacts the second U-shaped bend 30 and is cammed upwardly and over the reverse bend portion 82 of the second U-shaped portion 30. Because the hook shaped latch element is resilient with further movement inwardly of the brace 19 toward the front face 16 of the outer metal shell 11, the latch element 50 will spring back and move downwardly so that the hook portion 52 will engage the groove 38 formed along the second U-shaped portion 30 of the front face 16. With this arrangement then, the brace 19 is securely retained in its proper position relative to the corners of the outer metal shell 11 as shown in FIGS. 2 and 5 without the need of a separate fastening means which was necessary heretofore.

When the braces 19 are in position as shown in FIGS. 2 and 5 in the front face at each of the upper corners of the outer metal shell, the anti-sweat loop 14 may be retained by the braces. This is accomplished by bending the anti-sweat loop to form a right angle at each of the corners and the anti-sweat loop 14 is inserted into the open portion of the braces and positioned in the corner 84 formed between the first leg 46 and the base 44. As can be seen particularly in FIG. 2, the anti-sweat loop 14 is retained in the corner area 84 by the downwardly directed tang 54. The guide element 74 with its curved edge 76 located in the corner area 72 of the brace 19 is to aid in guiding the right angle shaped anti-sweat loop 14 into its proper location in the brace 19 and to help urge it into the corner 84 of the brace 19.

Subsequent to the above-described positioning of the corner braces 19 in the outer metal shell 11 and the insertion of the anti-sweat loop 14 into the corner braces because there is a plastic liner 86 having an edge portion 88 inserted into the space between the second inner wall 26 and third inner wall 28 of the front face 16. As mentioned previously, the projections 60 and 62 and smaller projections 64 and 66 of the brace 19 are utilized to minimize the foam insulation material from flowing out through the miter slot 68 in the front face 16 and other potential leak areas at each corner of the outer metal shell 11. These projections provide a controlled chamber between the brace and outer metal shell into which is injected a plug material such as foamable hot melt material which solidifies prior to the introduction of foam insulation resin, thus sealing any potential leak area. Thereafter, polyurethane foam resin is introduced into the space between the liner 86 and the outer metal shell 11 and is expanded by blowing agents to fill the space with a thermal insulation material 90 which is also utilized as an adhesive to join all of the components together to form a unitized rigid refrigerator cabinet body.

The foregoing is a description of the preferred embodiment of the invention and it should be understood that variations may be made thereto without departing from the true spirit of the invention as defined in the appended claims.

What is claimed is:

1. A cabinet assembly for a refrigerator having two top front corners comprising:

an outer sheet metal shell having a top panel, side panels and a front face, said front face is formed to provide a first U-shaped portion which includes a first outer wall perpendicular to the side panel to form a corner and a second inner wall spaced from the first outer wall, both walls being connected by the first U-shaped portion, said second inner wall being reversely bent to form a third wall and provide a second U-shaped portion formed between the second inner wall and the third wall, said first, second and third walls being in spaced parallel planes with the third wall bent at a right angle to form a flange having a free terminal edge, said second U-shaped portion being formed to provide a groove area therein; and a brace located at each of the two top front corners of the cabinet and having two integrally joined sections at right angles to each other and each section is formed as an inwardly open U-shaped channel having a base, a first leg and a second leg spaced apart and integrally joined to the base, said base being adjacent the rear surface of the third wall of the front face with the first leg parallel to and abutting the side and top panels of the cabinet and the second leg parallel to and abutting the flange of the front face, said brace having at least one resilient hook shaped latch element on each of the two formed sections and extending from the first leg beyond the base and engaging the second U-shaped portion in the groove area to secure the brace to the outer metal shell.

2. The cabinet assembly for a refrigerator according to claim 1 wherein there are two resilient hook shaped latch elements spaced from each other on each of the two joined sections.

3. The cabinet assembly for a refrigerator according to claim 1 wherein the brace is formed from plastic material.

4. The cabinet assembly for a refrigerator according to claim 1 wherein the hook shaped latch element diverges downwardly from the first leg of the brace.

5. The cabinet assembly for a refrigerator according to claim 1 wherein the brace has two spaced apart upstanding projections in the area where the two sections are integrally joined to form a controlled chamber between the brace and outer metal shell for receiving a plug material.

6. The cabinet assembly for a refrigerator according to claim 5 wherein the plug material is a foamable hot melt material.

7. The cabinet assembly for a refrigerator having a freezer compartment on top with two top front corners, a fresh food compartment on the bottom, a mullion partition between the compartments and a hot anti-sweat loop comprising:

an outer sheet metal shell having a top panel, side panels and a front face, said front face is formed to provide a first U-shaped portion which includes a first outer wall perpendicular to the side panel to form a corner and a second inner wall spaced from the first outer wall, both walls being connected by the first U-shaped portion, said second inner wall being reversely bent to form a third wall and provide a second U-shaped portion formed between the second inner wall and the third wall, said first, second and third walls being in spaced parallel planes with the third wall bent at a right angle to form a flange having a free terminal edge, said second U-shaped portion being formed to provide a groove area therein; and a brace located at each of the two top front corners of the cabinet and having two integrally joined sections at right angles to each other and each section is formed as an inwardly open U-shaped channel having a base, a first leg and a second leg spaced apart and integrally joined to the base at right angles to form corners between the base and each of the legs, said base being adjacent the rear surface of the third wall of the front face with the first leg parallel to and abutting the side and top panels of the cabinet and the second leg parallel to and abutting the flange of the front face, said brace having at least one resilient hook shaped latch element on each of the two joined sections and extending from the first leg beyond the base and engaging the second U-shaped portion in the groove area to secure the brace to the outer metal shell and having means to retain the hot anti-sweat loop within the inwardly open U-shaped channel.

8. The cabinet assembly for a refrigerator according to claim 7 wherein there are two spaced apart resilient hook shaped latch elements on each of the two joined sections.

9. The cabinet assembly for a refrigerator according to claim 7 wherein the brace is formed from plastic material.

10. The cabinet assembly for a refrigerator in accordance with claim 7 wherein the means to retain the hot anti-sweat loop within the brace is a lanced tang in the first leg of each of the two joined sections which is joined at one end to the first leg and has a front terminal end spaced from the base, said tang being resilient and dimensioned to receive the hot anti-sweat loop between the front terminal end and the corner formed between the base and first leg to retain it in position on each of the two joined sections of the brace.

11. The cabinet assembly for a refrigerator according to claim 10 wherein the tang diverges downwardly from the first leg between the hinged end and the front terminal end.

12. The cabinet assembly for a refrigerator according to claim 11 wherein there are two spaced apart resilient hook shaped latch elements on each of the two joined sections and the tang is located intermediate the spaced hook shaped latch elements on each joined section.

* * * * *